US006818294B2

(12) United States Patent
Kikutani et al.

(10) Patent No.: US 6,818,294 B2
(45) Date of Patent: Nov. 16, 2004

(54) POLYOXYMETHYLENE FIBER AND METHOD FOR PRODUCTION THEREOF

(75) Inventors: Takeshi Kikutani, Tokyo (JP); Hidetoshi Okawa, Fuji (JP)

(73) Assignee: Polyplastics Co., Ltd., Tokyo (JP)

( * ) Notice: Subject to any disclaimer, the term of this patent is extended or adjusted under 35 U.S.C. 154(b) by 0 days.

(21) Appl. No.: 10/485,648

(22) PCT Filed: Sep. 17, 2002

(86) PCT No.: PCT/JP02/09517

§ 371 (c)(1),
(2), (4) Date: Feb. 3, 2004

(87) PCT Pub. No.: WO03/025268

PCT Pub. Date: Mar. 27, 2003

(65) Prior Publication Data

US 2004/0175566 A1 Sep. 9, 2004

(30) Foreign Application Priority Data

Sep. 18, 2001 (JP) ..... 2001-283391

(51) Int. Cl.[7] ..... D01F 6/00; D01F 3/10; C08G 2/30; D01D 5/12

(52) U.S. Cl. ..... 428/364; 428/394; 525/398; 525/400; 264/210.7; 264/211.14

(58) Field of Search ..... 428/364, 394; 525/398, 400; 523/220; 528/270; 264/210.7, 211.14

(56) References Cited

U.S. PATENT DOCUMENTS

| | | | | |
|---|---|---|---|---|
| 3,293,205 A | * | 12/1966 | Doyle et al. | 523/220 |
| 3,437,640 A | * | 4/1969 | Schweitzer et al. | 525/398 |
| 3,477,994 A | * | 11/1969 | Schweitzer et al. | 525/400 |
| 3,608,044 A | * | 9/1971 | Coplan et al. | 264/210.7 |
| 4,287,149 A | | 9/1981 | Capaccio et al. | 264/210.7 |

FOREIGN PATENT DOCUMENTS

| | | |
|---|---|---|
| JP | 43-6101 | 3/1968 |
| JP | 45-21951 | 7/1970 |
| JP | 60-183122 | 9/1985 |
| JP | 61-54921 | 3/1986 |
| JP | 2001-172821 | 6/2001 |
| JP | 2001-247344 | 9/2001 |

* cited by examiner

*Primary Examiner*—N. Edwards
(74) *Attorney, Agent, or Firm*—Nixon & Vanderhye P.C.

(57) ABSTRACT

Polyoxymethylene fiber having a high strength and a high modulus of elasticity is provided. Polyoxymethylene fiber comprising polyoxymethylene copolymer having a half-crystallization time of at least 30 sec, when the polyoxymethylene copolymer is cooled from a melted state at 200° C. to 150° C. at a cooling speed of 80° C./min and maintained constantly at the temperature of 150° C.

24 Claims, No Drawings

POLYOXYMETHYLENE FIBER AND METHOD FOR PRODUCTION THEREOF

This application is the U.S. national phase of international application PCT/JP02/09517 filed 17 Sep. 2002 which designated the U.S. and claims benefit of JP 2001-283391 dated 18 Sep. 2001, the contents of each of which are hereby incorporated by reference.

TECHNICAL FIELD OF THE INVENTION

The present invention relates to fiber of high strength and high modulus of elasticity comprising a polyoxymethylene copolymer, and a process for producing the same. More particularly, by use of a polyoxymethylene copolymer with a crystallization rate controlled appropriately, improvement of a process for producing fiber, or combination thereof, occurrence of in-fibril voids during stretching is inhibited, whereby polyoxymethylene fiber having high strength and high modulus of elasticity can be obtained.

BACKGROUND ART

A polyoxymethylene copolymer having an oxymethylene group as main repeating units is excellent in mechanical properties such as rigidity and strength, chemical resistance, solvent resistance, electric properties and the like, and has a high crystallization rate, and therefore it is a material very suitable for general molding processes such as injection molding, and is widely used for working parts of automobiles and electric appliances taking advantage of its various properties and molding processability.

On the other hand, owing to these mechanical properties, chemical resistance, solvent resistance, electric properties and the like, fiber comprising the polyoxymethylene (co) polymer is expected to be applied to a variety of products such as concrete reinforcing fiber and various kinds of cross-meshed filters.

However, because of the high crystallization rate, the polyoxymethylene (co)polymer has a problem such that in-fibril voids occur and thus fiber is easily cut during melt spinning of fiber and stretching process and as a result, productivity cannot be improved, and fiber having high strength cannot be obtained.

In addition, in JP-A 60-183122, JP-A 61-54921 or the like, a process for producing polyacetal having high strength and high modulus of elasticity by highly stretching a polyacetal (polyoxymethylene) molded article by making the polyacetal molded article pass through a pressurized fluid is disclosed, and filaments and the like are illustrated as obtained stretched articles, but this process is lacking in productivity as a process for producing polyacetal (polyoxymethylene) fiber, and has a problem such that very fine and uniform fiber cannot be obtained.

As described above, the fiber comprising a polyoxymethylene (co)polymer has excellent properties and is expected to be used based on the properties, but is not yet in the actual use due to the above problems, and alleviation of the problems has been desired.

DISCLOSURE OF THE INVENTION

The present invention is to solve the problems such as those described above and provide fiber of high strength and high modulus of elasticity comprising polyoxymethylene, and a process for producing the same with high production efficiency.

As a result of vigorous studies for achieving the above purpose, the inventors found that a crystallization rate of polyoxymethylene to use, and heating conditions of fiber spun from a nozzle and taken off in production of fiber are very important factors, and conducted further detailed studies, resulting in completion of the present invention.

That is, the present invention is firstly directed to polyoxymethylene fiber comprising a polyoxymethylene copolymer that has a half-crystallization time of at least 30 sec when the polyoxymethylene copolymer is cooled from a molten state at 200° C. to 150° C. at a cooling rate of 80° C./min and maintained constantly at the temperature of 150° C. (hereinafter referred to as the first invention sometimes).

The present invention is secondly directed to a process for producing the polyoxymethylene fiber characterized by taking off fibrous matter spun from a spinning nozzle of melt spinning apparatus while heating in an ambient temperature of from 140 to 250° C., when the polyoxymethylene copolymer is subjected to melt spinning to produce the polyoxymethylene fiber (hereinafter referred to as the second invention sometimes).

The present invention is further directed to a fiber use of the above polyoxymethylene copolymer or a polyoxymethylene copolymer produced by the above process.

DETAILED DESCRIPTION OF THE INVENTION

The present invention will be described in detail below. First, polyoxymethylene fiber as the first invention in this application is characterized by comprising a polyoxymethylene copolymer having a half-crystallization time of at least 30 sec when the polyoxymethylene is cooled from a molten state at 200° C. to 150° C. at a cooling rate of 80° C./min and maintained constantly at the temperature of 150° C. The polyoxymethylene copolymer that is used has preferably a half-crystallization time of at least 100 sec, especially preferably at least 150 sec. Here, the half-crystallization time is an index of a crystallization rate, and the half-crystallization time defined in the present invention is a value measured by a measuring method shown in Examples described later. In the present invention, if a polyoxymethylene copolymer having a half-crystallization time less than 30 sec is used, polyoxymethylene fiber having high strength and high rigidity cannot be obtained with an ordinary fiber producing apparatus and under ordinary production conditions, and production with high productivity is impossible. If a polyoxymethylene copolymer having a long half-crystallization time is used, on the other hand, occurrence of in-fibril voids and cutting of fiber associated therewith during melt spinning of fiber and stretching process are inhibited to improve productivity, a high stretch ratio becomes possible, and fiber of high strength and high modulus of elasticity can be obtained by improving molecular orientation.

In the present invention, the method for adjusting a half-crystallization time of a polyoxymethylene copolymer that is used is not specifically limited, but preferable is a method of adjusting the half-crystallization time with the content of monomer components constituting the polyoxymethylene copolymer, especially the content of units of oxyalkylene in the polymer.

Here, the polyoxymethylene copolymer has an oxymethylene group as main repeating units, which contain repeating units comprising comonomer components capable of being copolymerized but in the present invention, a polyoxymethylene copolymer containing repeating units of oxyalkylene represented by the following formula (1) in repeating units of oxymethylene:

$$-[-(CH_2)_n-O-]_m- \quad (1)$$

(In the formula, n represents an integer of two or more; and m is an integer of one or more. It is preferable that n is 2 to 4 and m is 1 to 2).

Here, for the polyoxymethylene copolymer for use in the present invention, an content of the repeating units of oxyalkylene represented by formula (1) is preferably from 0.5 to 10 mole percent to the total repeating units of oxymethylene and oxyalkylene and further, in terms of control of the half-crystallization time described above, the content of the repeating units of oxyalkylene represented by formula (1) is from 2.0 to 10 mole percent to the total repeating units of oxymethylene units and oxyalkylene. The polyoxymethylene copolymer having a half-crystallization time adjusted by adjusting the content of repeating units of oxyalkylene in this way is especially suitable for production of fiber having high strength and high rigidity with high productivity, with occurrence of in-fibril voids in fiber in production of fiber considerably inhibited. Furthermore, if the content of repeating units of oxyalkylene becomes excessively high, ultimate crystallinity drops, thus making it impossible to obtain fiber having high strength.

The process for producing such a polyoxymethylene copolymer for use in the present invention is not specifically limited, but a process in which trioxane and a cyclic ether compound as a comonomer are subjected to bulk polymerization using mainly a cation polymerization catalyst is generally used. For polymerization apparatus, any well known apparatus such as a batch-type apparatus or continuous apparatus may be used. Cyclic ether compounds for use as a comonomer include ethylene oxide, propylene oxide, butylene oxide, epichlorohydrin, epibromohydrin, styrene oxide, oxetane, 3,3-bis(chloromethyl) oxetane, tetrahydrofuran, trioxepane, 1,3-dioxolane, propylene glycol formal, diethylene glycol formal, triethylene glycol formal, 1,4-butanediol formal, 1,5-pentanediol formal, and 1,6-hexanediol formal and among them, ethylene oxide, 1,3-dioxolane, diethylene glycol formal and 1,4-butanediol formal are preferable. The amount of the cyclic ether compound to be used is adjusted as appropriate in consideration of the content of units of preferable oxyalkylene described previously and the like.

Post-treatment and stabilization of a polyoxymethylene copolymer obtained by polymerization, for example, treatment for deactivation of a catalyst, removal of unreacted monomers, washing and drying of a polymer, treatment for stabilization of unstable terminals, and stabilization treatment by blending various kinds of stabilizers may be carried out by known methods.

Polyoxymethylene obtained as described above and used in the present invention preferably has a weight average molecular weight of 10,000 to 500,000, especially preferably 20,000 to 150,000. In addition, for the terminal group, the amount of hemiformal detected through $^{1}$H-NMR is preferably 0 to 4 mmol/kg, especially preferably 0 to 2 mmol/kg. If the amount is greater than 4 mmol/kg, foaming associated with decomposition of the polymer tends to occur during melt process, which may cause cutting of fiber. For controlling the amount of a hemiformal terminal group to be kept in the above range, the content of impurities, especially water, in the total amount of monomer and comonomer supplied for polymerization is preferably 20 ppm or less, especially preferably 10 ppm or less.

Furthermore, general additives for thermoplastic resins, for example one or two types of colorants such as dyes and pigments, a lubricant, a release agent, an antistatic agent, a surfactant, an organic polymer material, and an inorganic or organic fibrous, powdered or tabular filler agent may be added to the polyoxymethylene copolymer for use in the present invention as required as long as the object of the present invention is not impaired.

The polyoxymethylene copolymer as described above has distinctive crystallization properties, and therefore exhibits an effect of improvement irrespective of which process is used for producing fiber comprising such a copolymer, but the process for producing fiber described in detail below dramatically improves productivity of fiber, and strength, modulus of elasticity and the like of obtained fiber, and is thus very preferable.

That is, the second invention in this application is characterized by taking off fibrous matter spun from a spinning nozzle of melt spinning apparatus while heating in an ambient temperature of from 140 to 250° C., when the polyoxymethylene copolymer is subjected to melt spinning to produce the polyoxymethylene fiber.

The configuration of melt spinning apparatus that is used here is not specifically limited and for example, it may be constituted by a melt spinning apparatus comprising a melt kneader, a gear pump and a spinning nozzle, and a roller for taking off in a fibrous form and winding a molten polymer spun from the spinning nozzle.

The polyoxymethylene copolymer as a raw material is molten in this melt spinning apparatus, spun from the spinning nozzle in a fibrous form and taken off, and wound around the roller. At this time, taking off fibrous matter spun from the spinning nozzle while heating in an ambient temperature of from 140 to 250° C. characterizes the second invention. If the ambient temperature in which the fibrous matter is heated is less than 140° C., a solidification rate increases to compromise productivity, and fiber capable of being stretched at a high stretch ratio is hard to be obtained, thus making it difficult to obtain fiber having high strength and high modulus of elasticity. On the other hand, if the ambient temperature is equal to or greater than 250° C., fiber is wound around the roller before it is sufficiently solidified to compromise operability. The ambient temperature for heating fibrous matter spun from a spinning nozzle is preferably 140 to 220° C.

In addition, where a point selected from the range of 0 to 10 cm from the surface of the spinning nozzle is taken as a heat-starting point (L1) and a point selected from the range exceeding 5 cm from the surface of the spinning nozzle is taken as a heat-finishing point (L2), when fibrous matter spun from the spinning nozzle is heated in an ambient temperature as described above, heating is preferably carried out between L1 and L2 [herein, $L2 \leqq L1+5$ (unit: cm)].

Furthermore, the heat-starting point (L1) is preferably selected from the range of 0 to 3 cm from the surface of the spinning nozzle, especially preferably 0 cm from the surface of the spinning nozzle.

In addition, the heat-finishing point (L2) is preferably selected from the range of 5 to 200 cm from the surface of the spinning nozzle, further preferably the range of 10 to 100 cm from the surface of the spinning nozzle, especially preferably the range of 10 to 80 cm from the surface of the spinning nozzle. In addition, the length of a heat interval is preferably +5 to 200 cm, especially preferably 10 to 100 cm. In setting of the heat interval, conditions leading to early solidification of fibrous matter spun from the spinning nozzle, for example, setting the heat-starting point (L1) to a position far away from the surface of the spinning nozzle, and setting the length of the heat interval to an extremely small length cause degradation in productivity of fiber and the properties of obtained fiber, and are not preferable. In addition, conditions leading to extremely delayed solidification of fibrous matter spun from the spinning nozzle, for example, setting the heat-finishing point (L2) to a position far away from the surface of the spinning nozzle to extremely increase the length of the heat interval cause problems similar to those caused by elevation of an ambient heating temperature.

When fibrous matter spun from the spinning nozzle is heated, in this way, heating means is not specifically limited, but a tube-like (e.g. cylindrical) heater is most convenient and efficient, and by placing in close contact with or proximity to a spinning die a tube-like heater having a desired length with the above heating conditions taken into consideration, heating can be carried out under desired conditions.

Fibrous matter molten in melt spinning apparatus, spun (drawn) in a fibrous form from the spinning nozzle, and heated under atmosphere of certain temperature as described above is taken off at a high speed and wound around the roller. At this time, the speed at which fiber is taken off is preferably 300 to 5,000 m/min, especially preferably 1,000 to 5,000 m/min, and heating of fibrous matter under specific conditions after spinning the fibrous matter, which characterizes the present invention, makes it possible to take off fibrous matter at such a very high speed to improve productivity.

The fiber obtained in this way and wound around the roller can be further heat-stretched into stretched fiber. That is, in a method in which fiber is unwound from a roller and wound around a winding roller while heating the fiber at about 100 to 160° C., the ratio in speed between the unwinding roller and the winding roller is set as appropriate to obtain fiber having a predetermined stretch ratio. The heating method in this case is not specifically limited, but a method of contacting heated air, heated liquid or a heated plate may be used.

The second invention described above is characterized in the production method, the polyoxymethylene copolymer for use in the method is not specifically limited, use of a polyoxymethylene copolymer having a controlled crystallization rate as described in the first invention significantly improves productivity of fiber, strength of obtained fiber and modulus of elasticity, and is thus especially preferable.

According to the present invention, in fiber comprising a polyoxymethylene copolymer and production of the same, a crystallization rate or the like of the polyoxymethylene copolymer that is used is controlled, and fibrous matter spun from a spinning nozzle is heated under an atmosphere of controlled temperature in melt spinning, whereby solidification of fiber that is taken off is appropriately controlled and consequently, cutting of fiber is prevented to improve productivity. In addition, the obtained fiber is stretchable at a high stretch ratio, and molecular orientation is improved with the high stretch ratio, thus making it possible to obtain fiber having high strength and high modulus of elasticity.

EXAMPLES

The present invention will be described in detail below with Examples.

Furthermore, various kinds of measurements in Examples were carried out using the following methods.

[Measurement of Melt Index] (hereinafter abbreviated as MI)

Measurements were made at a temperature of 190° C. and under a load of 2.16 kg.

[Half-Crystallization Time]

Using a differential scanning calorimeter model: DSC7 manufactured by PerkinElmer Inc., about 5 mg of sample was molten at 200° C., and then cooled at a rate of 80° C./min. The temperature was kept constant when it reached 150° C., and an endothermic and exothermic curve (DSC chart) developing as time elapsed after the sample started to be kept at a constant temperature was recorded. Specifically, an exothermic peak associated with crystallization of resin is recorded. From this DSC chart, an amount of time between the instant when the sample started to be kept at a temperature of 150° C. and the instant when half the area of the exothermic peak was reached was determined, and taken as a half-crystallization time.

[Strength]

Measurements were made on fiber using a tensile strength tester.

[Analysis of Polymer Composition]

A polymer used for evaluation of properties was dissolved in hexafluoroisopropanol $d_2$ to make $^1$H-NMR measurements. A quantitative determination was made from the area of a peak corresponding to each unit.

[Analysis of terminal Group]

A polymer used for evaluation of properties was dissolved in hexafluoroisopropanol $d_2$ to make $^1$H-NMR measurements. A quantitative determination was made from the area of a peak corresponding to each terminal.

Examples 1 to 6 and Comparative Examples 1 and 2

Using a continuous mixing reactor comprised of a barrel provided on the outer face with a jacket through which a heating (cooling) medium and having a cross section having a shape such that two circles partly overlap each other, and rotating shafts with paddles, liquid trioxane and a cyclic ether compound shown in Table 1 were added while two rotating shafts with paddles were rotated at 150 rpm, respectively, and bulk polymerization was carried out while methylal as a molecular weight modifier and 0.005 part by weight of (based on 100 parts by weight of total monomers) borate trifluoride as a catalyst were further supplied continuously to a polymerization apparatus at the same time to obtain a polymer having a polymer composition shown in Table 1. A reaction product was made to pass quickly through a crusher while it was added to a 600° C. aqueous solution containing 0.05 wt % of triethylamine to deactivate the catalyst. Further, after separation, washing and drying, a crude polyoxymethylene copolymer was obtained. Then, 4 parts by weight of 5 wt % triethylamine aqueous solution and 0.3 part by weight of pentaerythritol-tetrakis[3-(3,5-di-tert-butyl-4-hydroxyphenyl)propionate] were added to 100 parts by weight of the crude polyoxymethylene copolymer, and the resultant mixture was melt-kneaded at 210° C. by a biaxial extruder to remove unstable portions. The structure and copolymerization composition of the obtained polyoxymethylene copolymer were identified by $^1$H-NMR measurement using hexafluoroisopropanol $d_2$ as a solvent.

0.03 part by weight of pentaerythritol-tetrakis[3-(3,5-di-tert-butyl-4-hydroxyphenyl)propionate] as a stabilizer and 0.15 part by weight of melamine were added to 100 parts by weight of the polyoxymethylene copolymer obtained through the process described above, and the resultant mixture was melt-kneaded at 210° C. by a biaxial extruder to obtain pellet of polyoxymethylene copolymer.

The polyoxymethylene obtained in this way was spun using a spinning apparatus comprising a melt kneader with a cylinder temperature set at 200° C., a gear pump and a spinning nozzle (0.6 mm diameter, 10 ports), and fibrous matter spun from the spinning nozzle was wound around a roller. The spinning rate was 3 g/min for each hole. The fibrous matter was taken off at a rate of 1,000 m/min.

Then, the fiber wound around the roller was unwound from the roller, and wound around a winding roller at a rate equal to or greater than the unwinding rate while heating with a hot roller heated at 150° C., whereby the fiber was stretched. For making evaluations on possible stretch ratios, in this stretching operation, the ratio of the speed of the unwinding roller to the speed of the winding roller was changed, and a stretch ratio at which cutting of fiber began to occur was taken as a maximum stretch ratio. In addition, the strength of fiber was measured using fiber obtained by stretching by a maximum stretch ratio of 85%. The evaluation results are shown in Table 1.

TABLE 1

| | | Polymer composition *2 | | Polymer properties | | | Ambient | Evaluation results | |
|---|---|---|---|---|---|---|---|---|---|
| | Type of comonomer | Oxyalkylene units | Mol % | Half crystallization time (min) | MI (g/10 min) | Hemiformal (mmol/kg) | temperature during spinning (° C.) | Stretch ratio | Strength (g/d) |
| Example 1 | 1,3-dioxolane | $(CH_2CH_2O)$ | 1.3 | 0.5 | 9 | 0.2 | 23° C. | 6.2 | 8 |
| Example 2 | 1,3-dioxolane | $(CH_2CH_2O)$ | 2.2 | 3 | 9 | 0.2 | 23° C. | 7.8 | 9 |
| Example 3 | 1,3-dioxolane | $(CH_2CH_2O)$ | 4.0 | 40 | 9 | 0.2 | 23° C. | 8.9 | 11 |
| Example 4 | Ethylene oxide | $(CH_2CH_2O)$ | 1.3 | 3 | 9 | 0.2 | 23° C. | 7.8 | 9 |
| Example 5 | 1,3-dioxolane | $(CH_2CH_2O)$ | 2.2 | 3 | 9 | 5 | 23° C. | 7.2 *1 | 8.2 |
| Example 6 | 1,3-dioxolane | $(CH_2CH_2O)$ | 2.2 | 3 | 9 | 0.2 | 170° C. | 9.5 | 1.3 |
| Com. Example 1 | 1,3-dioxolane | $(CH_2CH_2O)$ | 0.52 | 0.1 | 9 | 0.2 | 23° C. | 4.2 | 5 |
| Com. Example 2 | — | | 0.0 | 0.05 | 9 | 0.2 | 23° C. | 3.7 | 4.3 |

*1 Foaming was recognized during spinning process and cutting easily occurred.
*2 Polymer composition is represented by a molar fraction of oxyalkylene units based on the total amount of oxymethylene units and oxyalkylene units.

Examples 7 to 13 and Comparative Examples 3 and 4

Fiber was spun and stretched in the same manner as in Examples 1 to 6 and evaluations were made except that polyoxymethylene copolymers of polymer compositions shown in Table 2 were used, and fibrous matter spun from the spinning nozzle was heated at ambient temperatures shown in Table 2 in spinning operations. Furthermore, a cylindrical heater having a length of 50 cm was used for heating of fibrous matter spun from the spinning nozzle, and one end of the heater was brought into close contact with the surface of a spinning die, whereby fibrous matter spun from the spinning nozzle was immediately heated under an atmosphere of predetermined temperature. The evaluation results are shown in Table 2.

TABLE 2

| | | Polymer composition | | | Ambient temperature | Evaluation results | |
|---|---|---|---|---|---|---|---|
| | Type of comonomer | Oxyalkylene units | Mol % | MI (g/10 min) | during spinning (° C.) | Stretch ratio | Strength (g/d) |
| Example 7 | 1,3-dioxolane | $(CH_2CH_2O)$ | 2.2 | 9 | 140° C. | 8.2 | 9.5 |
| Example 8 | 1,3-dioxolane | $(CH_2CH_2O)$ | 2.2 | 9 | 150° C. | 9.0 | 10.4 |
| Example 9 | 1,3-dioxolane | $(CH_2CH_2O)$ | 2.2 | 9 | 170° C. | 9.5 | 11.0 |
| Example 10 | 1,3-dioxolane | $(CH_2CH_2O)$ | 2.2 | 9 | 190° C. | 9.9 | 11.4 |
| Example 11 | 1,3-dioxolane | $(CH_2CH_2O)$ | 2.2 | 9 | 220° C. | 10.3 | 11.8 |
| Example 12 | 1,3-dioxolane | $(CH_2CH_2O)$ | 4.0 | 9 | 180° C. | 11.5 | 13.2 |
| Example 13 | 1,3-dioxolane | $(CH_2CH_2O)$ | 0.52 | 9 | 180° C. | 6.8 | 7.82 |
| Com. Example 3 | 1,3-dioxolane | $(CH_2CH_2O)$ | 0.52 | 9 | 23° C. | 4.2 | 5 |
| Com. Example 4 | 1,3-dioxolane | $(CH_2CH_2O)$ | 0.03 | 9 | 23° C. | 3.7 | 4.3 |

What is claimed is:

1. Polyoxymethylene fiber comprising a polyoxymethylene copolymer that has a half-crystallization time of at least 30 sec when the polyoxymethylene copolymer is cooled from a molten state at 200° C. to 150° C. at a cooling rate of 80° C./min and maintained constantly at the temperature of 150° C.

2. The polyoxymethylene fiber as described in claim 1 wherein the half-crystallization time of the polyoxymethylene copolymer is at least 100 sec.

3. The polyoxymethylene fiber as described in claim 1 wherein the polyoxymethylene copolymer contains repeating units of oxyalkylene represented by the following formula (1) in repeating units of oxymethylene:

$$-[-(CH_2)_n-O-]_m \quad (1)$$

(In the formula, n represents an integer of two or more; and m is an integer of one or more).

4. The polyoxymethylene fiber as described in claim 3 wherein a content of the repeating units of oxyalkylene represented by formula (1) is from 0.5 to 10 mole percent to the total repeating units of oxymethylene and oxyalkylene.

5. The polyoxymethylene fiber as described in claim 3 wherein the content of the repeating units of oxyalkylene represented by formula (1) is from 2.0 to 10 mole percent to the total repeating units of oxymethylene units and oxyalkylene.

6. The polyoxymethylene fiber as described in claim 1 wherein the polyoxymethylene copolymer contains therein from 0 to 4 mmol/kg of a hemiformal terminal group detected through $^{1}$H-NMR.

7. The polyoxymethylene fiber as described in claim 1 that is prepared by melt spinning at a take-off speed of from 300 to 5000 m/min.

8. The polyoxymethylene fiber as described in claim 1 that is prepared by melt spinning at a take-off speed of from 1000 to 5000 m/min.

9. The polyoxymethylene fiber as described in claim 1 that is prepared by further heating and stretching after the melt spinning.

10. A process for producing polyoxymethylene fiber, comprising taking off fibrous matter spun from a spinning nozzle of a melt spinning apparatus while heating at an ambient temperature of from 140 to 250° C., when the polyoxymethylene copolymer is subjected to melt spinning to produce the polyoxymethylene fiber.

11. The process for producing polyoxymethylene fiber as described in claim 10 wherein when a point selected in the range of 0 to 10 cm from the surface of the spinning nozzle is taken as a heat-starting point (L1) and a point selected from the range exceeding 5 cm from the surface of the spinning nozzle is taken as a heat-finishing point (L2), heating is carried out between L1 and L2 [herein, L2≧L1+5 (unit: cm)].

12. The process for producing polyoxymethylene fiber as described in claim 11 wherein the heat-starting point (L1) is selected in the range of from 0 to 3 cm from the surface of the spinning nozzle.

13. The process for producing polyoxymethylene fiber as described in claim 11 wherein the heat-starting point (L1) is 0 cm from the surface of the spinning nozzle.

14. The process for producing polyoxymethylene fiber as described in claim 11 wherein the heat-finishing point (L2) is selected in the range of from 5 to 200 cm from the surface of the spinning nozzle.

15. The process for producing pblyoxymethylene fiber as described in claim 11 wherein the heat-finishing point (L2) is selected in the range of from 10 to 100 cm from the surface of the spinning nozzle.

16. The process for producing polyoxymethylene fiber as described in claim 11 wherein the heat-finishing point (L2) is selected in the range of from 10 to 80 cm from the surface of the spinning nozzle.

17. The process for producing polyoxymethylene fiber as described in claim 11 wherein the taking-off speed of the fibrous matter is from 300 to 5000 m/min.

18. The process for producing polyoxymethylene fiber as described in claim 11 wherein the taking-off speed of the fibrous matter is from 1000 to 5000 m/min.

19. The process for producing polyoxymethylene fiber wherein the polyoxymethylene fiber prepared according to a process as described in 10 is further heated and stretched.

20. The process for producing polyoxymethylene fiber as described in claim 10 wherein the half-crystallization time of the polyoxymethylene copolymer is at least 30 sec, when the polyoxymethylene copolymer is cooled from a molten state at 200° C. to 150° C. at a cooling rate of 80° C./min and maintained constantly at the temperature of 150° C.

21. The process for producing polyoxymethylene fiber as described in claim 20 wherein the half-crystallization time of the polyoxymethylene copolymer is at least 100 sec.

22. The process for producing polyoxymethylene fiber as described in claim 10 wherein the polyoxymethylene copolymer contains repeating units of oxyalkylene represented by the following formula (1) in the repeating units of oxymethylene, and a content of the repeating units of oxyalkylene is from 2.0 to 10 mol percent to the total repeating units of oxymethylene and oxyalkylene $$-[-(CH_2)_n-O-]m- \quad (1)$$

(In the formula, n represents an integer of two or more; and m represents an integer of one or more).

23. A fiber which comprises the polyoxymethylene copolymer of claim 1.

24. A process for making a fiber comprise melt-spinning the polyoxymethylene copolymer of claim 1.

* * * * *